US006015043A

United States Patent [19]

Sandberg et al.

[11] Patent Number: 6,015,043

[45] Date of Patent: Jan. 18, 2000

[54] FOLDED BOTTLE DISPLAY PACKAGING

[75] Inventors: Thomas Michael Sandberg, Minneapolis; George Webinger, Golden Valley, both of Minn.

[73] Assignee: The Traveling Herbalist, Inc., Golden Valley, Minn.

[21] Appl. No.: 09/193,477

[22] Filed: Nov. 17, 1998

Related U.S. Application Data

[60] Provisional application No. 60/067,074, Nov. 20, 1997.

[51] Int. Cl.[7] ..... B65D 85/20; B65D 5/50

[52] U.S. Cl. ..... 206/446; 206/779; 206/780

[58] Field of Search ..... 206/756, 763–765, 206/775, 779–780, 782, 783, 781, 772, 773, 446–485; 248/174

[56] References Cited

U.S. PATENT DOCUMENTS

| | | | |
|---|---|---|---|
| D. 349,458 | 8/1994 | Verdaguer . | |
| D. 354,679 | 1/1995 | Dunn . | |
| D. 360,358 | 7/1995 | Steinfels, III . | |
| D. 369,102 | 4/1996 | Paré . | |
| D. 372,423 | 8/1996 | Cook . | |
| 2,505,399 | 4/1950 | Hilton | 206/756 |
| 2,727,620 | 12/1955 | Buttery . | |
| 2,788,189 | 4/1957 | Groya . | |
| 2,805,033 | 9/1957 | Rous | 206/446 X |
| 2,905,314 | 9/1959 | Bertram . | |
| 2,955,706 | 10/1960 | Emrick . | |
| 2,959,276 | 11/1960 | Srofe | 206/780 |
| 3,002,722 | 10/1961 | Cote | 206/780 X |
| 3,003,670 | 10/1961 | Srofe | 206/780 |
| 3,050,183 | 8/1962 | Mueller, Jr. | 206/780 |
| 3,070,222 | 12/1962 | Jones | 206/780 |
| 3,157,275 | 11/1964 | Tolaas | 206/780 |
| 3,517,801 | 6/1970 | Cote . | |
| 4,300,683 | 11/1981 | Roccaforte . | |
| 4,385,687 | 5/1983 | Dutcher | 206/779 |
| 4,660,720 | 4/1987 | Pugh . | |
| 4,662,512 | 5/1987 | Durand . | |

*Primary Examiner*—Bryon P. Gehman
*Attorney, Agent, or Firm*—Daniel A. Tysver; Beck & Tysver P.L.L.P.

[57] ABSTRACT

A display package for a bottle is presented having a relatively short base section and a folded wrap-around section. The base section has a top with a hole adapted for receiving the bottom of the bottle. The wrap-around section extends from the back of the base section over the top of the bottle and down to the front of the base. The top of the wrap-around section is shorter in length than the largest diameter of the bottle displayed in the packaging. A window in the front of the wrap-around section allows the upper-front portion of the bottle to extend through the window. In addition, the wrap-around section leaves majority of the bottle exposed through the open sides of the tent-like structure formed by the wrap-around section.

3 Claims, 3 Drawing Sheets

FOLDED BOTTLE DISPLAY PACKAGING

This application claims the benefit of U.S. Provisional Application No. 60/067,074, filed Nov. 20, 1997.

FIELD OF THE INVENTION

The present invention relates generally to display packaging for bottles. More specifically, the present invention relates to a folded, wrap-around display packaging including a display window for viewing the bottle, where the bottle partially protrudes through the window.

BACKGROUND OF THE INVENTION

The use of display packaging to sell bottled products is well known. Generally, prior art packages fully enclose the bottle in a rectangular box. This type of packaging protects the bottle during shipping and display, but it does not allow the bottle or the bottle's label to be viewed by the potential purchaser. The ability to view the bottle being considered for purchase can have a significant impact on a consumer's buying decision.

Prior art bottle packages that do allow a bottle to be viewed usually leave the bottle vulnerable to breakage. Whether the bottle is placed in the display packaging before shipment or at the retail store, it is important that the display package provide protection against breakage of the bottle.

SUMMARY OF THE INVENTION

The present invention provides a display package for a bottle that allows the bottle to be viewed by purchasers while also protecting the bottle against breakage during shipment or handling. The package is created through folding a one-piece paperboard or cardboard blank. The resultant package has a relatively short base section with a solid bottom and a top with a circular hole. The hole in the top of the base section matches the circumference of the bottom portion of the bottle to be displayed in the packaging. The rest of the packaging is formed by a folded "wrap-around" section of the blank. The wrap-around section extends from the back portion of the base to the top of the bottle. The wrap-around section is then folded approximately 90 degrees so as to form a top portion that covers the top of the bottle. The wrap-around section is folded a second time at an angle greater than 90 degrees to extend down to the front of the base section. The top portion of the wrap-around section is shorter than the diameter of the bottle displayed in the packaging. A window is included in the wrap-around section to allow the upper-front portion of the bottle to extend through the window. Preferable, the window allows the potential buyer to view a significant portion of the bottle. In addition, the wrap-around section leaves majority of the bottle exposed through the open sides of the tent-like structure formed by the wrap-around section.

DETAILED DESCRIPTION OF THE INVENTION

Figure 1:
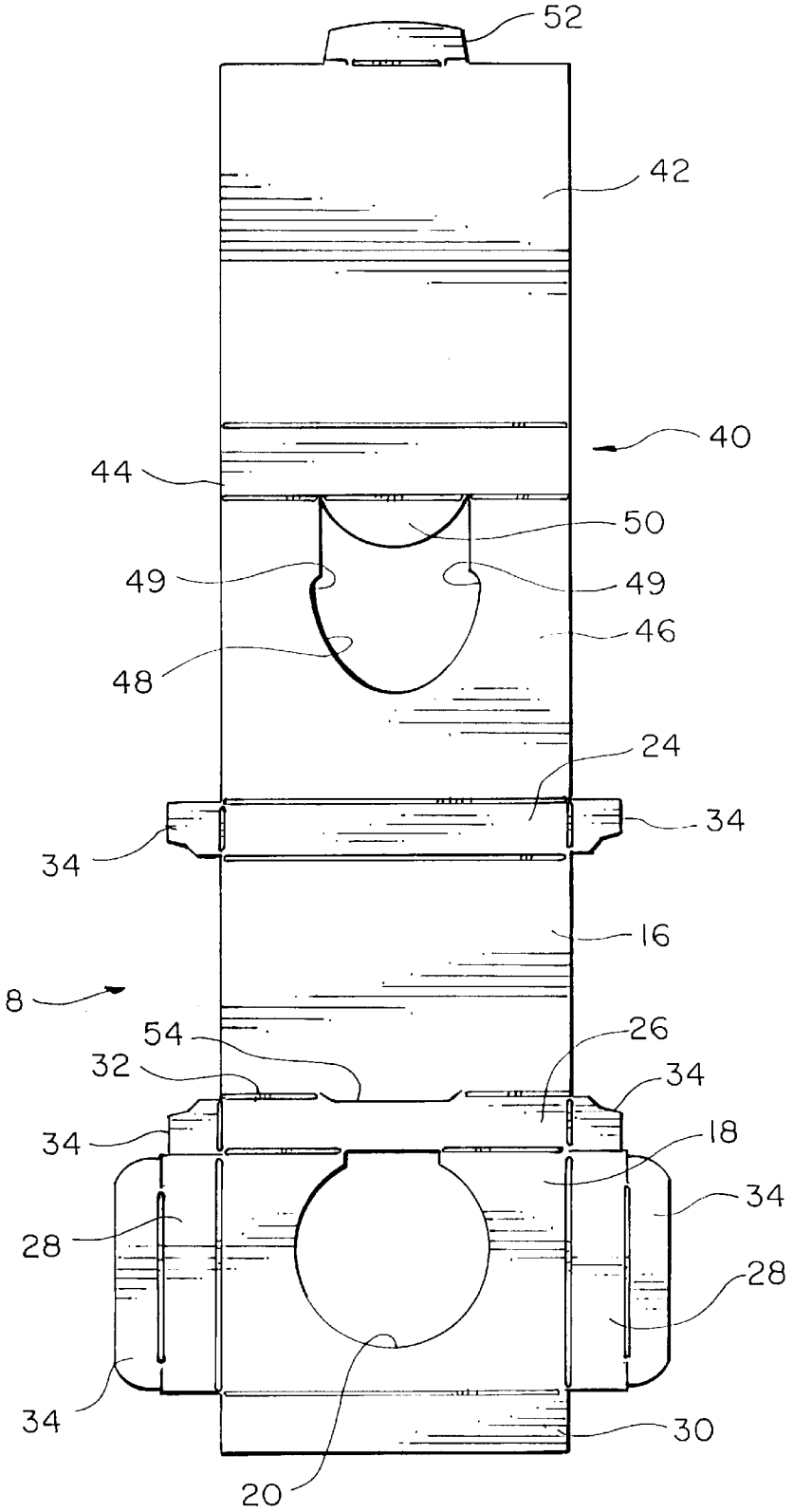
FIG. 1 is a plan view of a blank used to form the display packaging of the present invention.
Figure 2:
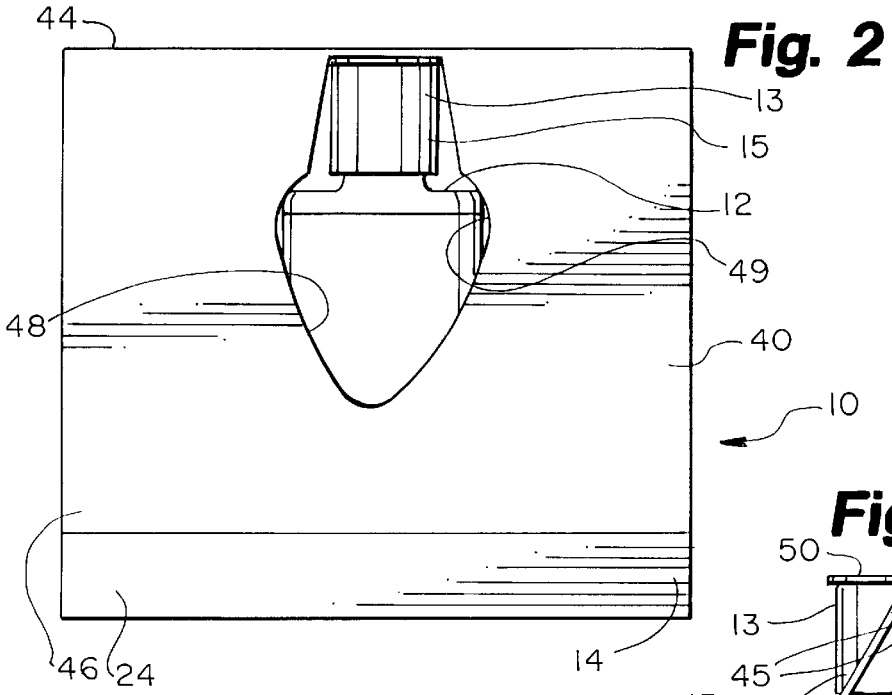
FIG. 2 is a front view of the constructed display packaging containing a bottle having a label.
Figure 3:
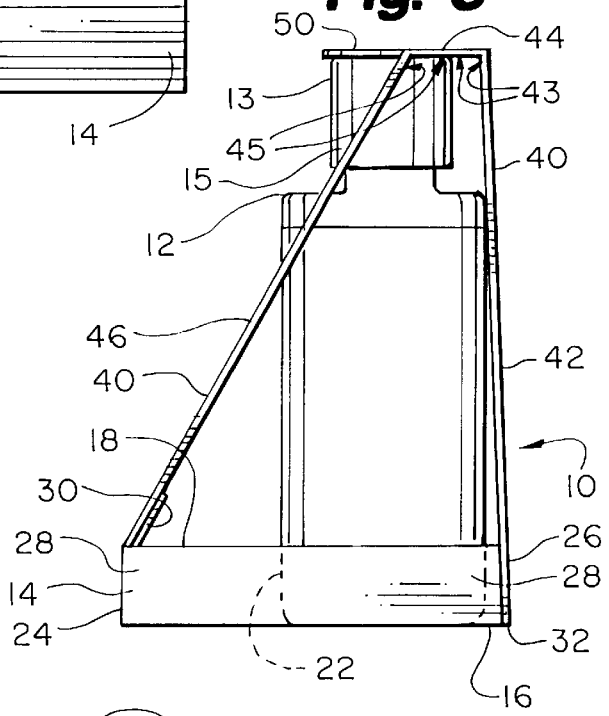
FIG. 3 is a side view of the display packaging and bottle shown in FIGS. 2.
Figure 4:
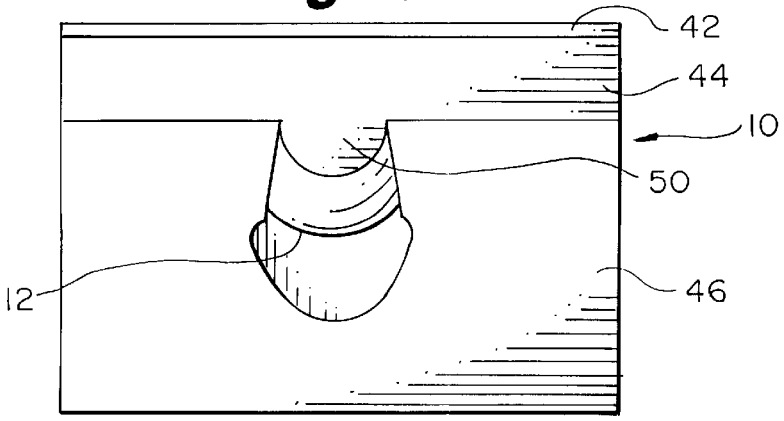
FIG. 4 is a top view of the display packaging and bottle shown in FIG. 2 and 3.

FIG. 1 shows the blank 8 used to create the display package 10 of the present invention. FIG. 1 shows fold lines, such as fold line 32, as light lines on the blank 8. FIGS. 2 through 4 show the display package 10 in use, containing a bottle 12.

The display package 10 has a relatively short base section 14 with a solid bottom 16 and a top 18. The top 18 has a hole 20 shaped to accommodate the bottom portion 22 of the bottle 12. In addition to the bottom 16 and top 18, the base section 14 has a front panel 24, back panel 26, and two side panels 28. Support flap 30 is used for securing the shape of the package 10, and does not form an additional panel in the constructed package 10. Additional tabs 34 are also used only to help maintain the structure of the base section 14, as is well known in the prior art.

The rest of the package 10 is formed by a "wrap-around" section 40. As can be seen in the drawings, this wrap-around section 40 has a single, uniform width equal to the width of the base section 14. A back wall 42 of the wrap-around section 40 extends from the back panel 26 of the base section 14 to a position proximate to the top of the bottle 12. The wrap-around section 40 is then folded at an interior angle 43 of approximately ninety (90) degrees so as to form a top portion 44 that covers the top of the bottle 12. This angle 43 could vary on slightly on either side of ninety (90) degrees without significantly altering the invention. The top portion 44 is generally parallel to the top of bottle 12. The wrap-around section 40 is folded a second time at an interior angle 45 that is greater than ninety (90) degrees. This second fold forms a front wall 46 that extends down to the front panel 24 of the base section 14.

Support panel 30 is preferably glued to the lower inside portion of the front wall 46, as is shown in FIG. 3. The process of gluing panel 30 to front wall 46 ideally takes place prior to the folding of blank 8 into the package 10. To do this, the blank 8 is folded once at fold line 32 between back panel 26 and bottom 16. Panel 30 is then glued to front wall 46 so that the blank 8 can be shipped flat.

In the blank 8 shown in FIG. 1, front wall 46 is formed attached to front panel 24. To secure the end of the wrap-around section 40 to the base section 14, tab 52 (which extends from back panel 42) is inserted into a slot 54 that is cut along fold line 32.

The top portion 44 of the wrap-around section 40 has a length that is shorter than i) the uniform width of the wrap-around section, ii) the diameter of bottle 12, and iii) the length of side panels 28 of the base section 15. A window 48 is included in the front wall 46 of wrap-around section 40 to allow a top portion 13 of the bottle 12 to extend through the window 48. The top portion 13 of bottle 12 is shown in FIGS. 2 and 3 covered by a cap 15. The window 48 is sized so as to allow the top portion 13 of the bottle 12 to protrude through the plane formed by the front wall 46 of the package 10. As part of this sizing, a bulge 49 has been cut into window 48 to allow for the wider portion of bottle 12 to extend through the window 48. Although front wall 46 is referred to as planar in this description, it is clear that a gentle curve in front wall 46 is acceptable in forming this "planar" front wall 46.

The window 48 is preferably cut into package 10 so as to leave a top flap 50 in the window. This top flap 50 extends along the same plane as top portion 44 over window 48. In this way, top flap 50 further secures the bottle 12 in position. The top flap 50 can also provide additional area for printing on the package 10, such as for the placement of a circular seal.

The window 48 can be created larger than is necessary to accommodate the top portion 13 of bottle 12. As shown in FIG. 2, an extended window allows the potential buyer to view a significant portion of the bottle, including a label. Because the wrap-around section 40 creates a tent-like package with open sides, it is possible to view the majority of the bottle 12 through the side of package 10, as is shown in the side view of FIG. 3. This construction allows the potential buyer further viewing access to the bottle 12 and its label. At the same time, the vast majority of the bottle 12 is protected from impact damage by package 10.

Figure 5:
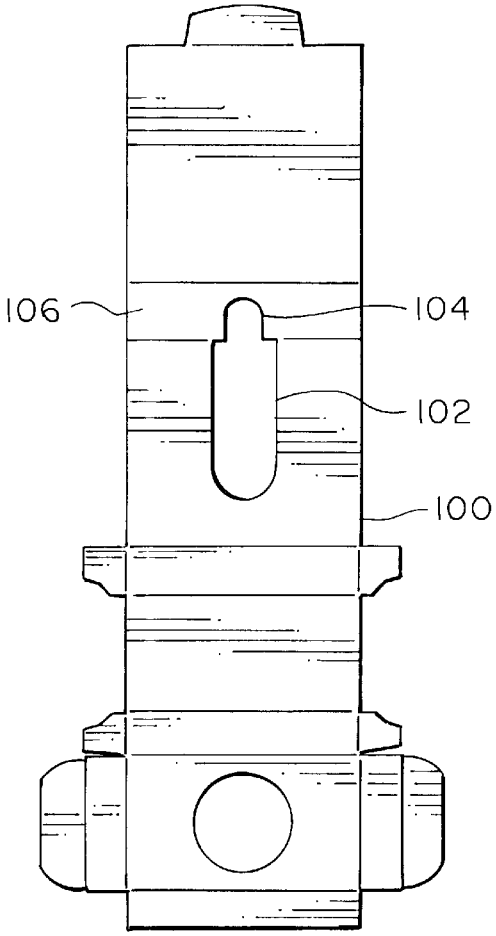
FIG. 5 is a plan view of a blank used to form a second embodiment of the display packaging of the present invention.
Figure 6:
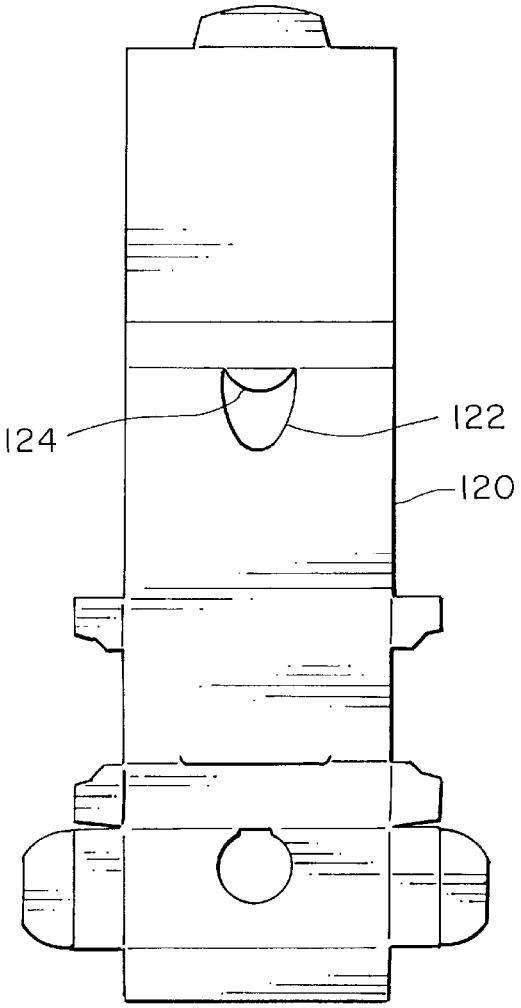
FIG. 6 is a plan view of a blank used to form a third embodiment of the display packaging of the present invention.

The window 48 and top flap 50 can be altered as necessary and desired, depending on the shape of the bottle being displayed. FIGS. 5 and 6 show alternative embodiments of window 48. In the blank 100 shown in FIG. 5, window 102 is elongated. In addition, the top flap has been replaced by notch 104 in top portion 106. This blank is useful for bottles containing an eye dropper extending from the top of the bottle. The rubber top of the eye-dropper can extend through notch 104, while the rest of the bottle can be restrained by top portion 106.

FIG. 6 shows blank 120 with alternative window 122. In this construction, a top flap 124 is still used to help contain the bottle. However, window 122 does not have the bulge 49 shown in FIGS. 1 and 2. This is because the blank 120 is utilized with a bottle having a relatively uniform diameter.

The invention is not to be taken as limited to all of the details thereof as modifications and variations thereof may be made without departing from the spirit or scope of the invention. For instance, although the term bottle is used to describe the item being displayed in the package of the present invention, the term is used in a sense that is broader than that commonly used. The "bottle" displayed by the present invention may be a glass bottle, a metal can, a plastic container, or any other similarly shaped item that may be advantageously sold in the packaging of the present invention.

What is claimed is:

1. A display package for a bottle that has a bottom and a top; the display package comprising:

(a) a base section having a bottom, a top, a front, a back, and a front-to-back length, the top having a hole therein adapted for receiving the bottom of the bottle; and (b) a wrap-around section having (i) a back side having a bottom edge and a top edge, the bottom edge attached to the back of the base section, (ii) a generally planar top portion attached to the top edge of the back side, the top portion having a length smaller than the front-to-back length of the base section, and (iii) a generally planar front side extending from the top portion to the front of the base section, the front side having a window proximate the top portion, the window being adapted to allow a portion of the top of the bottle to extend through the plane created by the front side by passing through the window.

2. The display package of claim 1, wherein the wrap-around section further comprises:

(iv) open sides that allow direct viewing of an interior of the display package.

3. The display package of claim 1, wherein the wrap-around section further comprises:

(iv) a top flap that extends from the top portion to project over the window.

* * * * *